United States Patent [19]

Salentine

[11] Patent Number: 4,717,490

[45] Date of Patent: Jan. 5, 1988

[54] SYNERGISTIC COMBINATION OF ALKALI METAL BORATES, SULFUR COMPOUNDS, PHOSPHITES AND NEUTRALIZED PHOSPHATES

[75] Inventor: Christopher G. Salentine, San Rafael, Calif.

[73] Assignee: Chevron Research Company, San Francisco, Calif.

[21] Appl. No.: 913,286

[22] Filed: Sep. 30, 1986

[51] Int. Cl.[4] ..... C10M 141/10

[52] U.S. Cl. ..... 252/32.7 E; 252/18; 252/25; 252/32.5; 252/45

[58] Field of Search ..... 252/18, 25, 32.5, 32.7 E, 252/45

[56] References Cited

U.S. PATENT DOCUMENTS

| | | | |
|---|---|---|---|
| 4,163,729 | 8/1979 | Adams | 252/18 |
| 4,472,288 | 9/1984 | Frost, Jr. | 252/32.7 E |
| 4,534,873 | 8/1985 | Clark | 252/32.7 E |

*Primary Examiner*—Jacqueline V. Howard

*Attorney, Agent, or Firm*—S. R. LaPaglia; R. C. Gaffney; J. J. DeYoung

[57] ABSTRACT

It has been found that a lubricating oil containing: (1) an alkali metal borate; (2) an oil-soluble sulfur compound; (3) a dialkyl hydrogen phosphite; and (4) a mixture of neutralized phosphates said phosphates being essentially free of monothiophosphates interacts synergistically to provide a lubricant with superior load carrying properties.

14 Claims, No Drawings

SYNERGISTIC COMBINATION OF ALKALI METAL BORATES, SULFUR COMPOUNDS, PHOSPHITES AND NEUTRALIZED PHOSPHATES

BACKGROUND OF THE INVENTION

The invention relates to extreme pressure lubricating oils, particularly alkali metal borate-containing lubricants.

Alkali metal borates are well known in the lubricant industry for their usefulness as extreme pressure agents. See, for example, U.S. Pat. Nos. 3,313,727; 3,565,802; 3,819,521; 3,846,313; 3,853,772; 3,907,691; 3,912,639; 3,912,643; 3,912,644; 3,997,454; and 4,089,790.

U.S. Pat. No. 4,459,215 discloses a lubricating composition containing an alkali metal borate, a sulfur-containing compound and a zirconium salt.

U.S. Pat. No. 4,575,431 discloses discloses a lubricating oil containing a mixture of phosphates said phosphates being essentially free of monothiophosphates.

U.S. Pat. No. 4,089,790 claims a synergistic lubricant mixture containing: (1) a hydrated potassium borate; (2) an antiwear agent selected from (a) zinc dihydrocarbyl dithiophosphate, (b) $C_1$–$C_{20}$ ester, $C_1$ to $C_{20}$ amide or $C_1$ to $C_{20}$ amine salt of a dihydrocarbyl dithiophosphoric acid, (c) zinc alkyl aryl sulfonate, and (d) mixture thereof; and (3) oil soluble antioxidant organic sulfur compound.

U.S. Pat. No. 4,171,268 claims lubricant compositions containing a zirconium salt of a carboxylic acid and oil-soluble sulfur-containing extreme pressure agent.

U.S. Pat. Nos. 4,563,302 and 4,204,969 disclose sulfurized olefins useful in lubricating oils.

It is one object of the invention to provide an alkali metal borate-containing lubricant which has superior load carrying properties.

SUMMARY OF THE INVENTION

It has been found that a lubricating oil containing: (1) an alkali metal borate; (2) an oil-soluble sulfur compound; (3) a dialkyl hydrogen phosphite; and (4) a mixture of neutralized phosphates said phosphates being essentially free of monothiophosphates interacts synergistically to provide a lubricant with superior load carrying properties.

DETAILED DESCRIPTION OF THE INVENTION

The lubricating oil composition of the present invention comprises four essential components: (1) an alkali metal borate; (2) an oil-soluble sulfur compound; (3) a dialkyl hydrogen phosphite; and (4) a mixture of neutralized phosphates said phosphates being essentially free of monothiophosphates.

THE ALKALI-METAL BORATES

The first essential component of the synergistic combination of the invention is a hydrated particulate alkali metal borate. The hydrated particulate alkali metal borates are well known in the art and are available commercially. Representative patents disclosing suitable borates and methods of manufacture include: U.S. Pat. Nos. 3,313,727; 3,819,521; 3,853,772; 3,907,601; 3,997,454; and 4,089,790, the entire disclosures of which are incorporated herein by reference.

The hydrated alkali metal borates can be represented by the following formula:

$$M_2O.mB_2O_3.nH_2O$$

where M is an alkali metal of atomic number in the range 11 to 19, i.e., sodium and potassium; m is a number from 2.5 to 4.5 (both whole and fractional); and n is a number from 1.0 to 4.8. Preferred are the hydrated potassium borates, particularly the hydrated potassium triborates microparticles having a boron-to-potassium ratio of about 2.5 to 4.5. The hydrated borate particles generally have a mean particle size of less than 1 micron.

THE OIL-SOLUBLE SULFUR COMPOUNDS

The second essential component of the synergistic combination of the invention is least one oil-soluble sulfur-containing compound. Any of the known types of organic sulfur compounds which have heretofore been suggested as being useful as extreme pressure agents may be used as a sulfur-containing agent in the invention. These include organic sulfides and polysulfides, sulfurized oils and esters or fatty acids, and mixtures thereof. These sulfur compounds may contain other groups which are beneficial and these include halogen groups.

Examples of organic sulfides and polysulfides which are useful as EP agents include aliphatic and aromatic sulfides and polysulfides such as hexyl, sulfide, octadecyl sulfide, butyl disulfide, amyl disulfide, hexyl disulfide, octadecyl disulfide, diphenyl sulfide, dibenzyl sulfide, dixylyl sulfide, diphenyl disulfide, dinaphthyl disulfide, diphenol disulfide, dibenzyl disulfide, bis(-chlorobenzyl) disulfide, dibenzyl trisulfide, dibutyltetrasulfide, sulfurized dipentene and sulfurized terpene.

A preferred class of sulfur-containing additives are those made by reacting sulfur and/or sulfur monochloride with an olefin such as isobutylene. Particularly preferred are the sulfurized olefins disclosed in U.S. Pat. Nos. 4,563,302 and 4,204,969, the entire disclosures of which are incorporated herein by reference.

Halogenated derivatives of the above sulfides and polysulfides are useful and examples include the chlorinated and fluorinated derivatives of diethyl sulfide and disulfide, dioctyl sulfide, diamyl sulfide and disulfide, diphenyl sulfide and disulfide, and dibenzyl sulfide and disulfide. A more exhaustive listing of sulfur and halogen EP agents which may be used is found in U.S. Pat. No. 2,208,163. Examples of sulfurized oils include sulfurized sperm oil, sulfurized methyl ester of oleic acid, sulfurized sperm oil replacements. Other examples of sulfurized oils include sulfurized methyl linoleate, sulfurized animal and vegetable oils, sulfurized lard oil, and sulfurized cottonseed oil.

THE PHOSPHITES

The third essential component of the synergistic combination of the invention is a dialkyl hydrogen phosphite. Dialkyl hydrogen phosphites useful in the present invention include $(RO)_2P(O)H$ where R is a hydrocarbyl of 4 to 30 carbon atoms, preferably 10 to 20 carbon atoms. The hydrocarbyl may be saturated or unsaturated. Representative dialkyl hydrogen phosphites include di-R-hydrogen phosphite where R is oleyl, octyl, lauryl, stearyl, linoleyl, linolenyl, lignoceryl, tridecyl, cetyl, tetradecyl, hexadecyl, and erucyl. Preferred are mixtures of phosphites containing different hydrocarbyl groups having 10 to 20 carbon atoms. These mixtures are usually derived from animal or natural vegetable sources. Representative hydrocarbyl mixtures are commonly known as coco, tallow, tall oil, and soya. Commercially available phosphites include LZ 5901 from the Lubrizol Corporation and Improvex 120 from Rhone Poulenc.

THE NEUTRALIZED PHOSPHATES

The fourth essential component of the synergistic combination of the present invention is a mixture of neutralized phosphates. This mixture is disclosed in my U.S. Pat. No. 4,575,431 the entire disclosure of which is incorporated herein by reference. This component comprises a mixture of phosphates, said phosphates being essentially free of monothiophosphates and comprising: (a) dihydrocarbyl hydrogen dithiophosphates; and (b) a sulfur-free mixture of hydrocarbyl dihydrogen phosphates and dihydrocarbyl hydrogen phosphates said composition being at least 50% neutralized by a hydrocarbyl amine having 10 to 26 carbons in said hydrocarbyl group.

As used in the present application the term "essentially free of monothiophosphates" means that the lubricant or lubricant additive does not contain any monothiophosphates that are materially detrimental to the extreme pressure properties of the lubricant. Preferably the lubricant or lubricant additive of the present invention contains no monothiophosphates whatsoever.

Each of the individual components of the phosphates used to make the mixture of neutralized phosphates is well known in the art.

THE DITHIOPHOSPHATES

Typical dithiophosphates are those containing two hydrocarbyl groups and one hydrogen functionality, and are therefore acidic. The hydrocarbyl groups useful herein are preferably aliphatic alkyl groups of 3 to 8 carbon atoms.

Representative dihydrocarbyl dithiophosphates include di-2-ethyl-1-hexyl hydrogen dithiophosphate, diisoctyl hydrogen dithiophosphate, dipropyl hydrogen dithiophosphate and di-4-methyl-2-pentyl hydrogen dithiophosphate.

Preferred dithiophosphates are dihexyl hydrogen dithiophosphate, dibutyl hydrogen dithiophosphate, and di-n-hexyl hydrogen dithiophosphate.

THE SULFUR-FREE PHOSPHATES

Typical non-sulfur-containing phosphates include the dihydrocarbyl hydrogen phosphates and the monohydrocarbyl dihydrogen phosphates where the hydrocarbyl will contain 1 to 10, and preferably 3 to 5 carbon atoms, and most preferably 4 carbon atoms. The hydrocarbyl is an aliphatic alkyl group. Representative phosphates include:

methyl dihydrogen phosphate, propyl dihydrogen phosphate, butyl dihydrogen phosphate, dibutyl hydrogen phosphate; dipentyl hydrogen phosphate; pentyl dihydrogen phosphate; hexyl dihydrogen phosphate, decyl dihydrogen phosphate, and the like.

Preferred is a mixture of dibutyl hydrogen phosphate, and butyl dihydrogen phosphate.

NEUTRALIZATION OF THE PHOSPHATES WITH AMINES

The mixture of acidic phosphates is partially or completely neutralized by reaction with alkylamines. The resulting composition is a complex mixture of alkylammonium salts, mixed acid-alkylammonium salts and acids of the sulfur-free mono and dihydrocarbyl phosphates and alkylammonium salts and free acids of the dihydrocarbyl dithiophosphates. Neutralization must be at least 50%, preferably at least 80% complete. For best results, neutralization should be in the range of 85 to 95%, wherein 100% neutralization refers to the reaction of one alkylamine with each acid hydrogen atom.

The amine alkyl group is from 10 to 30 preferably 12 to 18 carbons in length. Typical amines include pentadecylamine, octadecylamine, cetylamine, and the like. Most preferred is oleylamine. The mole ratio of the dithiophosphates to the sulfur-free phosphates should be in the range of 70:30 to 30:70, preferably 55:45 to 45:55 and most preferably 1:1. The mole ratio of the substituted dihydrogen phosphates to the disubstituted hydrogen phosphates should be in the range 30:70 to 55:45, preferably 35:65 to 50:50 and most preferably 45:55.

THE LUBRICATING OIL AND CONCENTRATION OF ADDITIVES

The lubricating oil to which the borates, sulfur compounds, phosphites and phosphates are added, can be any hydrocarbon-based lubricating oil or a synthetic-base oil stock. The hydrocarbon lubricating oils may be derived from synthetic or natural sources and may be paraffinic, naphthenic or asphaltic base, or mixtures thereof. The lubricating oil is used in the lubricant composition and the concentrate to make up 100 weight by weight.

The alkali-metal borate will generally comprise 0.1 to 20 weight percent of the lubricant composition, preferably 0.5 to 15.0 weight percent, and more preferably 2.0 to 9.0 weight percent. The oil-soluble sulfur compounds will comprise 0.1 to 10.0 weight percent of the lubricant composition, preferably 0.5 to 4.0, and more preferably 1.0 to 3.0 weight percent. The phosphites will comprise 0.01 to 10.0 weight percent of the lubricant composition, preferably 0.05 to 5.0 weight percent, and more preferably 0.10 to 1.0 weight percent. The phosphates will comprise 0.03 to 3.0 weight percent of the lubricant composition, preferably 0.07 to 1.5, and more preferably 0.15 to 0.9 weight percent.

The lubricating composition described above can be made by addition of a concentrate to a lubricating base oil. Generally, the lubricant will contain 1.0 to 10.0 weight percent of the concentrate and preferably 5.0 to 8.0 weight percent of the concentrate.

OTHER ADDITIVES

A variety of other additives can be present in lubricating oils of the present invention. These additives include antioxidants, viscosity index improvers, dispersants, rust inhibitors, foam inhibitors, corrosion inhibitors, other antiwear agents, and a variety of other well-known additives. Preferred dispersants include the well known succinimide and ethoxylated alkylphenols and alcohols. Particularly preferred additional additives are the oil-soluble succinimides and oil-soluble alkali or alkaline earth metal sulfonates.

EXAMPLES

The efficiency of the composition of this invention to impart load-carrying properties to lubricants is shown by the well known CRC (Coordinating Research Council) L-42 Axle Test which is described in ASTM publication STP 512, Library of Congress Catalog Card No. 72-76614. The results are shown in Table I.

Additive A consisted of a dispersion of potassium triborate and was used at a concentration of 3.0 weight percent in the blends of Table I.

Additive B consisted of a sulfurized isobutylene obtained from Edwin-Copper known as Hitec E-312. From laboratory analysis it is believed to consist of approximately 46 weight percent sulfur. It is used at a concentration of 2.0 weight percent in the blends of Table I.

Additive C consisted of dialkyl hydrogen phosphite obtained from Lubrizol which is known as LZ 5901. It consists of 6 weight percent phosphorus and it is used at a concentration of 0.3 weight percent in the blends of Table I.

Additive D consisted of a mixture of neutralized phosphates which are free of monothiophosphates. It consists of a mixture of 17.9 weight percent butyl acid phosphate obtained from Mobil Chemical Co. which is believed to be a mixture of dibutyl hydrogen phosphate and butyl dihydrogen phosphate; 29.5 weight percent di-n-hexyl dithiophosphate; and 52.6 weight percent oleylamine. It is used at a concentration of 0.45 weight percent in the blends of Table I.

The blends of Table I used an SAE 80W-90 base oil.

It should be observed that the exact composition of these above described formulations is not generally made public by the manufacturers of the respective compositions and can be at best only approximated analytically be considerable effort. Nevertheless, the presence of certain functional groups can be established with relative certainty and to a degree sufficient to illustrate the effectiveness of the compositions of this invention relative to previously described compositions. In addition, these compositions and information regarding their use are, of course, available from the respective manufacturers noted above.

TABLE I

| Example | Blend | Percent Scoring |
|---|---|---|
| 1 | A | 100 |
| 2 | B | 79 |
| 3 | C | 100[1] |
| 4 | D | 100[1] |
| 5 | A + B | 40 |
| 6 | A + B + C | 20 |
| 7 | A + B + D | 20 |
| 8 | A + B + C + D | 1 |

[1]100 assumed since component C and D are not known as being an extreme pressure additive.

Comparison of Examples 1 through 4 demonstrates that individually additives A, B, C, and D do not have significant extreme pressure properties at the concentrations used.

Example 5 demonstrates that additives A and B interact in a synergistic manner to reduce scoring to a low level.

Comparison of Examples 5 with 6 and 7 demonstrates that additive C and D individually interact in a synergistic manner with the mixture of A and B to provide reduced scoring.

Comparison of Examples 1 through 4 would lead one to expect poor preformance in the L-42 scoring test from mixtures of A, B, C or D.

Comparison of Examples 1 through 8 indicates that the four essential components of the present invention (additives A, B, C, and D) interact in a synergistic manner to provide a lubricant with superior load carrying properties.

What is claimed is:

1. A lubricating composition comprising an oil of lubricating viscosity having dispersed therein a minor amount of a mixture of:

(a) a hydrated alkali metal borate;
(b) an oil-soluble sulfur-containing compound;
(c) a dialkyl hydrogen phosphite; and
(d) a mixture of neutralized phosphates said phosphates being essentially free of monothiophosphates.

2. The composition of claim 1 wherein said lubricating composition comprises:

(a) 0.1 to 20 weight percent alkali metal borate;
(b) 0.1 to 10.0 weight percent sulfur-containing compound;
(c) 0.01 to 10.0 weight percent a dialkyl hydrogen phosphite; and
(d) 0.03 to 3.0 weight percent a mixture of neutralized phosphates said phosphates being essentially free of monothiophosphates.

3. The lubricant composition of claim 2 wherein said borate is a potassium triborate.

4. The lubricant composition of claim 2 wherein said sulfur-containing compound is a sulfurized isobutylene.

5. The lubricant composition of claim 2 wherein said phosphite is a mixture of $C_{10}$ to $C_{20}$ dialkyl hydrogen phosphites.

6. The lubricant composition of claim 2 wherein said phosphates comprise:

(a) dihydrocarbyl hydrogen dithiophosphates; and
(b) a sulfur-free mixture of hydrocarbyl dihydrogen phosphates and dihydrocarbyl hydrogen phosphates, said composition being at least 50% neutralized by a hydrocarbyl amine having 10 to 30 carbons in said hydrocarbyl group.

7. The composition of claim 6 wherein the hydrocarbyl groups in said dihydrocarbyl hydrogen dithiophosphate, hydrocarbyl dihydrogen phosphates, and dihydrocarbyl hydrogen phosphates are alkyl groups of 1 to 10 carbon atoms.

8. A lubricating oil concentrate comprising a mixture of:

(a) a hydrated alkali metal borate;
(b) an oil-soluble sulfur-containing compound;
(c) a dialkyl hydrogen phosphite; and
(d) a mixture of neutralized phosphates said phosphates being essentially free of monothiophosphates.

9. A lubricating composition comprising a major amount of lubricating oil and a minor but effective amount of the concentrate of claim 8 to improve the load carrying properties of the lubricating composition.

10. The composition of claim 9 wherein the composition contains 1.0 to 10.0 weight percent of said concentrate.

11. The lubricant composition of claim 10 wherein said borate is a potassium triborate.

12. The lubricant composition of claim 11 wherein said sulfur-containing compound is a sulfurized isobutylene.

13. The lubricant composition of claim 12 wherein said phosphite is a mixture of $C_{10}$ to $C_{20}$ dialkyl hydrogen phosphites.

14. The lubricant composition of claim 13 wherein said phosphates comprise:

(a) dihydrocarbyl hydrogen dithiophosphates; and
(b) a sulfur-free mixture of hydrocarbyl dihydrogen phosphates and dihydrocarbyl hydrogen phosphates, said composition being at least 50% neutralized by a hydrocarbyl amine having 10 to 30 carbons in said hydrocarbyl group.

* * * * *